US005614038A

United States Patent [19]

King et al.

[11] Patent Number: 5,614,038

[45] Date of Patent: Mar. 25, 1997

[54] METHOD FOR MAKING MACHINABLE LEAD-FREE COPPER ALLOYS WITH ADDITIVE

[75] Inventors: Michael G. King, Salt Lake City, Utah; Taie Li, Lakewood, Colo.

[73] Assignee: ASARCO Incorporated, New York, N.Y.

[21] Appl. No.: 493,337

[22] Filed: Jun. 21, 1995

[51] Int. Cl.[6] ..... C21D 1/09

[52] U.S. Cl. ..... 148/538; 148/553; 148/24

[58] Field of Search ..... 420/477, 499, 420/500, 577; 148/553, 22, 24, 538

[56] References Cited

U.S. PATENT DOCUMENTS

| | | | |
|---|---|---|---|
| 3,414,405 | 12/1968 | Fisher | 420/577 |
| 4,077,108 | 3/1978 | Mathern et al. | 29/403 |
| 4,879,094 | 11/1989 | Rushton | 420/476 |
| 5,137,685 | 8/1992 | McDevitt et al. | 420/499 |
| 5,167,726 | 12/1992 | Lolacono et al. | 148/432 |
| 5,330,712 | 7/1994 | Singh | 420/473 |
| 5,360,591 | 11/1994 | Ruetz et al. | 420/479 |

FOREIGN PATENT DOCUMENTS

| | | | |
|---|---|---|---|
| 2054047 | 5/1972 | Germany | 420/577 |
| 466675 | 6/1937 | United Kingdom | 420/500 |

OTHER PUBLICATIONS

Diagram redrawn from Sher., A.A.; Odin, I.P.: and Novoselova, A.V. "Investigation of the Phases in the Bi–Se System", Russ, J. Inorg. Chem; 31(3), 1986, pp. 435–437.

Encyclopedia of Chemical Technology, J. Wiley & Sons, 3rd Edition, vol. 20, 1982, pp. 589 and 595.

R.A. Zignaro & W.C. Cooper, *Selenium*, Van Nostrand Reinhold Co., New York, 1975, pp. 773, 775–777, 779 and 785.

*Primary Examiner*—Sikyin Ip

*Attorney, Agent, or Firm*—Delio & Peterson, LLC; Kenneth A. Koch

[57] ABSTRACT

Machinable lead free brasses for potable water applications are provided wherein a combination of bismuth and selenium are substituted in the alloy for lead and the bismuth and selenium are added to the alloy in the form of an additive product comprising bismuth selenide. A method of making the brasses which meets environmental and safety regulations is also provided. The bismuth selenide is preferably made by sintering particles of bismuth and selenium in a Bi/Se weight ratio of about 1.8 or greater and fusing the sinter.

7 Claims, No Drawings

METHOD FOR MAKING MACHINABLE LEAD-FREE COPPER ALLOYS WITH ADDITIVE

BACKGROUND OF THE INVENTION

1. Field of the Invention

This invention relates to lead free machinable copper based alloys and, in particular, to an additive comprising bismuth selenide for making machinable copper based alloys such as brasses which alloys can be substituted for conventional lead containing brasses in potable water applications.

2. Description of Related Art

Copper based alloys are used in many products and applications. Potable water products, such as plumbing fixtures and piping, use brasses and other copper based alloys. Lead, in amounts of about 1–9%, has been employed as an alloying ingredient in brasses to improve the machinability of the alloy. Red brasses contain about 2 to 8% zinc or more and are resistant to stress corrosion cracking and are easily formed. Yellow brasses contain greater than about 17% zinc, e.g., 30–45% zinc and have good ductility and high strength and can withstand cold working. Each type brass is preferred for certain applications.

Ingestion of lead by humans is considered harmful however, and the use of lead is being severely curtailed due to health and environmental concerns. Drinking water is one such concern and legislation has been proposed to reduce the concentration of lead in plumbing fixtures and fittings and thus to reduce the amount of lead leached into the water. Accordingly, there have been attempts to reduce the lead content of alloys and numerous elements have been proposed as substitutes for lead. The term "lead free" alloys referred to herein means that the alloy contains less lead than it usually contains and preferably less than 2%.

The substitutes for lead must also meet workplace, health and environmental standards and while there are substitutes for lead these materials present their own problems when used to make the alloy and in their fabrication and use of the alloy. Many of the materials are difficult to alloy and react violently when added to copper based alloys in the alloy making process and fume excessively causing safety, health and environmental problems. Likewise, some materials tend to leach from the alloy during use and cannot therefore be used in potable water applications.

Bismuth is considered non-toxic and has been used as a substitute for lead to improve the machinability of alloys. A number of patents have issued showing alloys having reduced lead contents with bismuth as a substitute.

U.S. Pat. No. 4,879,094 discloses a cast copper alloy containing 1.5–7% bismuth, 5–15% zinc, 1–12% tin and the balance copper. Another free machining brass is disclosed in Japanese Application 54-135618 containing 0.5–1.5% bismuth, 58–65% copper and the balance zinc. U.S. Pat. No. 5,360,591 shows reduced lead yellow brasses for plumbing applications containing 0–1% lead, 0.2–1.5 aluminum, 0.2–1.5% bismuth, 30–45% zinc and 55–70% copper. Japanese Applications 57-73149 and 57-73150 disclose copper alloys containing bismuth and additions of graphite and titanium and manganese. U.S. Pat. No. 5,167,726 discloses a wrought copper alloy containing bismuth and phosphorous, tin or indium. U.S. Pat. No. 5,137,685 discloses a copper alloy in which the lead content is reduced by the addition of bismuth. The alloy contains 30–58% zinc. To improve its machinability a sulfide, telluride or selenide may be added to the alloy or, to enhance their formation an element which combines with them such as zirconium, manganese, magnesium, iron, nickel or mischmetal may be added.

Selenium is likewise known for use in copper base alloys and additions of 0.25–1% as copper selenide improve the machinability of the alloy more than do sulfur, tellurium or bismuth and have little effect on the strength and decreases the ductility and conductivity only slightly. Studies of the microstructure of selenium containing copper shows the presence of Cu—$Cu_2Se$ eutectic which serves to break up the chips during machining.

Selenium however, unlike bismuth, is considered toxic and is controlled by regulations limiting the amount of selenium in the workplace and in the environment. Selenium when added to a copper base alloy in the alloy making process fumes excessively and poses a health hazard. The use of selenium therefore, while useful as a substitute for lead, suffers from many of the same problems as lead.

Bearing in mind the problems and deficiencies of the prior art, it is therefore an object of the present invention to provide lead free copper based alloys made by adding bismuth selenide to the alloy as a substitute for lead, the alloys being machinable and suitable for uses in which there are manufacturing, health and environmental concerns.

It is another object of the present invention to provide lead free brasses which are machinable and which may be used in potable water applications.

A further object of the invention is to provide an environmental and safe method for making lead free copper base alloys including lead free brasses which contain bismuth and selenium added as bismuth selenide as a substitute for lead and which are machinable and may be used in potable water applications.

It is yet another object of the present invention to provide an additive product comprising bismuth selenide for making copper base alloys including brasses.

An additional object of the invention is to provide a method for making a additive comprising bismuth selenide which additive can be used to make lead free alloys including copper based alloys and brasses.

Still other objects and advantages of the invention will in part be obvious and will in part be apparent from the specification.

SUMMARY OF THE INVENTION

It has been found that copper base alloys may have some or all of their lead content substituted for by bismuth and selenium and that the alloys are machinable and exhibit other desired properties needed for use in applications where there are health and environmental concerns such as potable water fixtures and piping. The bismuth and selenium are incorporated into the alloy (e.g., adding to the molten alloy) in the form of an additive comprising a bismuth selenide. The bismuth selenide additive may be in the form of the intermetallic compound or as an alloy or sintered product containing bismuth selenide. The phase diagram for bismuth and selenium is shown in "*Investigation of the Phases in the Bi-Se System*" by Sher, A. A.; Odin, I. P.; and Novoselova, A. Y.; Russ. J. Inorg. Chem.; 31(3), 1986; pp. 435–437. At about, by weight, 36% Se and 64% Bi, the bismuth selenide intermetallic compound $Bi_2Se_3$ is formed. If greater than about 36% Se (less than 64% Bi) is used to make the compound, $Bi_2Se_3$+Se is formed. Below about 36% Se (greater than 64% Bi) a number of bismuth selenide intermetallic compounds would be formed including (1) $Bi_2Se_3$+BiSe; (2) BiSe; (3) $Bi_3Se_2$; and (4) $Bi_3Se_2$+Bi. BiSe exists over the range of 22%–31% Se and within that range structurally related layer phases $Bi_4Se_3$, $Bi_6Se_5$, $Bi_2Se_2$, $Bi_8Se_9$ and $Bi_6Se_7$ can be isolated. The term bismuth selenide as used herein means any of the above forms of bismuth selenide. The preferred bismuth selenide because of its demonstrated effectiveness is $Bi2Se_3$ made using stoichiometric amounts of bismuth and selenium (64% bismuth and 36% selenium by weight). It will also be noted that the bismuth selenide may be present in the additive with elemental bismuth or selenium depending on the relative amounts used to make the intermetallic compound as discussed above.

It is an important feature of the invention from a health, safety and environmental standpoint that substantially all the bismuth and selenium added to the alloy, and especially the selenium, be added in the form of bismuth selenide since both the bismuth and selenium are transferred to the copper base alloy with no significant loss of bismuth or selenium due to fuming. It has also been found that the combination of bismuth and selenium in the alloy provides enhanced machinability properties compared to the use of these elements individually or the use of lead. Additionally, the bismuth has an inhibiting effect on leaching of the selenium from the alloy when the bismuth and selenium are added to the alloy as bismuth selenide, preferably when the additive comprising bismuth selenide contains a Bi/Se weight ratio of about 1.8 or greater, preferably greater than 2 to less than 5. Depending on the amounts of bismuth used, the additive will comprise bismuth selenide and elemental bismuth.

The bismuth selenide additive product is preferably made by heating bismuth and selenium particles to form a sinter. When amounts of bismuth and selenium are used to provide a Bi/Se weight ratio of about 1.8, the sinter contains predominately bismuth selenide greater than 95% to 99% or more as $Bi_2Se_3$. It is preferred to use an amount of bismuth above about 64% by weight, preferably 67–80% to avoid free selenium in the additive. The sinter may be used directly as the additive for the copper based alloy however, it is preferred to fuse (melt) the sinter to convert any free selenium to the selenide and/or to form a denser product.

Broadly stated, the copper base alloy comprises, by weight, about 0.1 to 7 bismuth, preferably 1 to 4% about 0.1 to 3.5% selenium, preferably 0.5 to 1 or 2% other alloying elements and the balance essentially copper. For red brasses, the copper base alloy comprises, by weight, about 0.1 to 7% bismuth, preferably 1 to 4%, about 0.1 to 3.5% selenium, preferably about 0.5 to 1 or 2%, about 2 to 12% zinc, preferably about 4 to 6%, up to about 6% tin and the balance essentially copper. For yellow brasses, the copper base alloy comprises, by weight, about 0.1 to 7% bismuth, preferably 1 to 4% about 0.1 to 3.5% selenium, preferably 0.5 to 1 or 2%, about 17 to 45% zinc, up to 6% tin and the balance essentially copper. It is preferred that the weight ratio of Bi/Se in the alloy be above about 1.8, preferably greater than about 2 and less than about 5. A preferred brass contains about 1% Bi, 0.5% Se, zinc, tin and the balance essentially copper.

In another aspect of the invention, the bismuth and selenium are added to the alloy in various bismuth selenide containing additive product forms in which the bismuth to selenium weight ratio is preferably greater than about 1.8 preferably greater than about 2 and less than about 5. In general, the additive comprises, by weight, about 60 to 90% bismuth, preferably 64 to 80% and most preferably 67 to 75% and the balance essentially selenium. It is preferred to employ amounts of bismuth in excess of about 64% by weight when making the additive product so to minimize the presence of free selenium in the additive. When more than 64% bismuth is used, the additive product comprises bismuth selenide and depending on the amount of bismuth used, elemental bismuth. It is also contemplated herein that the additive product comprising bismuth selenide may contain other elements such as copper, tin and zinc and the like with the invention being the need for a bismuth selenide containing additive product.

In another aspect of the invention a method is provided for making copper base alloys which comprises forming a melt of copper and alloying ingredients and adding an additive comprising bismuth selenide to the melt. The alloying ingredients and additive comprising bismuth selenide may be added to the copper melt in any order although it is preferred to add the bismuth selenium additive last.

DESCRIPTION OF THE PREFERRED EMBODIMENTS(S)

Any alloy containing both bismuth and selenium can utilize the additive product comprising bismuth selenide and method for making alloys of the present invention. For convenience however, the following description will be directed to copper base alloys and, in particular, to brasses. It has been found that, when both bismuth and selenium are added to an alloy in the form of an additive comprising bismuth selenide, lead can be replaced in the alloy either partially or totally. The bismuth selenium containing brasses exhibit excellent machinability, have no significant leaching of selenium when used in potable water applications and pose no health or environmental concerns in their manufacture or use. To inhibit leaching of selenium from the alloy it is preferred that the weight ratio of bismuth to selenium in the alloy be greater than about 1.8, and most preferably above about 2.

The copper base alloys comprise, by weight, about 0.1 to 7% bismuth, about 0.1 to 3.5% selenium, additional alloying elements such as zinc, tin, nickel, and phosphorous and the balance essentially copper. The weight ratio of Bi/Se in the alloy is preferably above 1.8, e.g., above about 2 and less than about 5.

The bismuth and selenium are added to the alloy in the form of an additive comprising bismuth selenide and as discussed above, other elements may also be in the additive product as elemental metal or as selenide without departing from the scope of the invention.

The bismuth selenide additive comprises by weight, about 60 to 90% bismuth, preferably 64 to 80%, e.g. 67 to 75% and the balance essentially selenium. Preferably a Bi/Se weight ratio greater than about 1.8 is used and substantially all the selenium is in the form of bismuth selenide, e.g., greater than 95%, preferably greater than 99%. The additive product is preferably made by sintering (heating) bismuth and selenium particles preferably in an inert atmosphere. The sinter comprises the intermetallic bismuth selenide compound and depending on the relative amounts of bismuth and selenium sintered, elemental bismuth or selenium in the matrix. The sinter product may be used as is. However, it is preferred to fuse (melt) the sinter to increase its density and usefulness in the alloy making process. When a Bi/Se weight ratio of about 1.8 is used, the sintered additive preferably comprises bismuth selenide in an amount greater than about 95% by weight.

To form a sintered addition product, the bismuth and selenium are formed into a coherent mass by heating particles of the bismuth and selenium together. The particle size of the particles may vary widely and is preferably 2 to 200 mesh. Generally, the bismuth and selenium particles undergo a solid-solid, liquid-solid or liquid-liquid reaction to form bismuth selenide, without exceeding the melting point of bismuth selenide which for $Bi_2Se_3$ is about 710° C. It is preferred that the addition product be formed in a protective atmosphere such as nitrogen to avoid oxidation. The sinter product is more than a mere mixture of bismuth and selenium particles, which mixtures are not useful, but is instead a sintered form of bismuth selenide. The sintered product is preferably fused (melted) to form an additive having improved handling and operating characteristics. The bismuth selenide additive product may also be made directly by melting (fusing) together bismuth and selenium. It is preferred however, to form a sinter first and then to fuse the sinter.

To prepare the copper base alloy it is preferred to form a melt of the copper and other alloying ingredients and to add the bismuth selenide additive to the melt. It has been found that when the bismuth selenide additive is used that there is no appreciable loss of bismuth or selenium from the melt by fuming and that the alloy making process passes the current OSHA Permissible Exposure Limits (PEL's). The alloys are found to have excellent machinability comparable and even exceeding leaded copper alloys. Leaching of selenium from the alloy in potable water applications has also been found to be inhibited when using the bismuth selenide additive of the invention.

The following examples are illustrative and in no way limitative of the present invention.

EXAMPLES

Example 1

Bismuth selenide ($Bi_2Se_3$) was made by melting together 6.4 pounds of bismuth and 3.6 pounds of selenium. The bismuth and selenium were charged into a graphite boat and melted in a quartz tube furnace at 850° C. for 1 hour with a reducing gas or inert gas atmosphere.

The bismuth selenide was added to brass at 2100° F. in an amount to make a brass alloy containing 0.90% Se by weight. The analyzed value for Se was 0.92% indicating no loss of Se in the alloy making process.

The brass alloy containing 2% Bi, 0.92% Se, 11.3% zinc, 2.7% tin and the balance copper had excellent machinability.

Example 2

A bismuth selenide sintered product was made using 25.6 pounds of −60 mesh bismuth powder and 14.4 pounds of −200 mesh selenium powder by intimately mixing the two powders and placing the mixed powders into a graphite boat. The graphite boat was then charged into a quartz tube furnace. The furnace was purged with an inert or reducing gas atmosphere. The temperature of the furnace was allowed to rise slowly until sintering occurred. As the sintering reaction is exothermic, the heat generated sustains the sintering reaction which was complete in less than 5 minutes. The temperature did not exceed about 710° C. the fusion point of $Bi_2Se_3$.

The bismuth selenide sinter product contained, by weight, 64% bismuth and 36% selenium of which more than 95% of the bismuth and selenium were in the form of bismuth selenide. The sinter was used to make a lead free brass alloy which had excellent machinability.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of incorporating bismuth and selenium in an alloy comprising the steps of:

providing a bismuth selenide sintered product consisting essentially of, by weight, about 60 to 90% bismuth and the balance selenium, and the Bi/Se weight ratio is about 1.8 to 5;

melting the bismuth selenide sintered product to form a fused bismuth selenide additive product;

melting the alloy and adding to the molten alloy the fused bismuth selenide additive product comprising an intermetallic bismuth selenide compound.

2. The method of claim 1 wherein the alloy is a brass.

3. The method of claim 2 wherein the brass comprises, by weight, about 2 to 12 % zinc and the balance essentially copper.

4. The method of claim 2 wherein the brass comprises, by weight, about 17 to 45% zinc and the balance essentially copper.

5. The method of claim 1 wherein the bismuth selenide sintered product is made by heating bismuth and selenium particles.

6. The method of claim 1 wherein the bismuth selenide sintered product is made under a protective atmosphere.

7. The method of claim 6 wherein the alloy is brass.

* * * * *